United States Patent [19]

Snyder et al.

[11] Patent Number: 4,914,872

[45] Date of Patent: Apr. 10, 1990

[54] APPARATUS AND METHOD FOR SELECTIVELY CONTOURING AN AIRFOIL ROOT

[75] Inventors: Kurt R. Snyder, Colchester; Randy M. DiNallo, Glastonbury; Steve J. Mezei, Tolland; all of Conn.; Eddie L. Teaster, West Palm Beach, Fl.

[73] Assignee: United Technologies Corporation, Hartford, Conn.

[21] Appl. No.: 266,315

[22] Filed: Nov. 3, 1988

Related U.S. Application Data

[63] Continuation of Ser. No. 56,336, May 22, 1987, abandoned, which is a continuation-in-part of Ser. No. 16,165, Feb. 19, 1987, abandoned.

[51] Int. Cl.[4] ..... B24B 19/14; B24B 1/00

[52] U.S. Cl. ..... 51/328; 51/310; 51/262 R; 51/274; 51/237 T

[58] Field of Search ..... 51/328, 310, 312, 262, 51/262.1, 274, 217 R, 237 T, 241 G, 215 AR, DIG. 14

[56] References Cited

U.S. PATENT DOCUMENTS

| | | | |
|---|---|---|---|
| 230,157 | 7/1880 | Sutherland | 51/217 |
| 391,419 | 10/1888 | McCulloch | 51/262.1 |
| 729,667 | 6/1903 | Robinson | 51/274 |
| 1,825,455 | 9/1931 | Hawes | 51/100 R |
| 2,166,461 | 7/1939 | Carlson | 51/237 T |
| 2,543,236 | 2/1951 | Dackor et al. | 51/237 T |
| 2,579,337 | 12/1951 | Reaser et al. | 51/101 |
| 3,346,897 | 10/1967 | Nelson | 51/217 |
| 3,589,072 | 6/1971 | Burt | 51/45 |
| 3,629,977 | 12/1971 | Holden | 51/98 R |
| 3,728,826 | 4/1973 | Wada et al. | 51/165.77 |
| 3,777,441 | 12/1973 | Kurimoto et al. | 51/105 SP |
| 3,780,474 | 12/1973 | Ota | 51/105 SP |
| 3,793,775 | 2/1974 | Ishikawa et al. | 51/165.77 |
| 3,797,176 | 3/1974 | Wespi | 51/101 R |
| 4,052,821 | 10/1977 | McCandless et al. | 51/237 T |
| 4,067,148 | 1/1978 | Kikuchi | 51/165.77 |
| 4,078,905 | 3/1978 | Oya | 51/328 |
| 4,241,471 | 12/1980 | Elias | 15/250 R |
| 4,512,110 | 4/1985 | Stump | 51/141 |
| 4,523,409 | 6/1985 | DeFazio | 51/165.71 |
| 4,530,861 | 7/1985 | Sippel et al. | 427/444 |
| 4,545,153 | 10/1985 | Miller et al. | 51/118 |
| 4,566,225 | 1/1986 | Bizot et al. | 51/165.72 |
| 4,606,152 | 8/1986 | Michihara et al. | 51/241 S |
| 4,622,449 | 11/1986 | Inoue | 219/69 R |

*Primary Examiner*—Robert Rose

*Attorney, Agent, or Firm*—Christopher T. Hayes

[57] ABSTRACT

A buffing guide includes a mating surface, a first guide surface, a second guide surface and means for engaging an airfoil root. The buffing guide directs a buffing wheel into precise contact with a root edge at a point where selective contouring is desired, with sustained contact providing a smooth radiused surface while avoiding the detrimental effects of grinding or milling operations.

12 Claims, 2 Drawing Sheets

FIG. 1
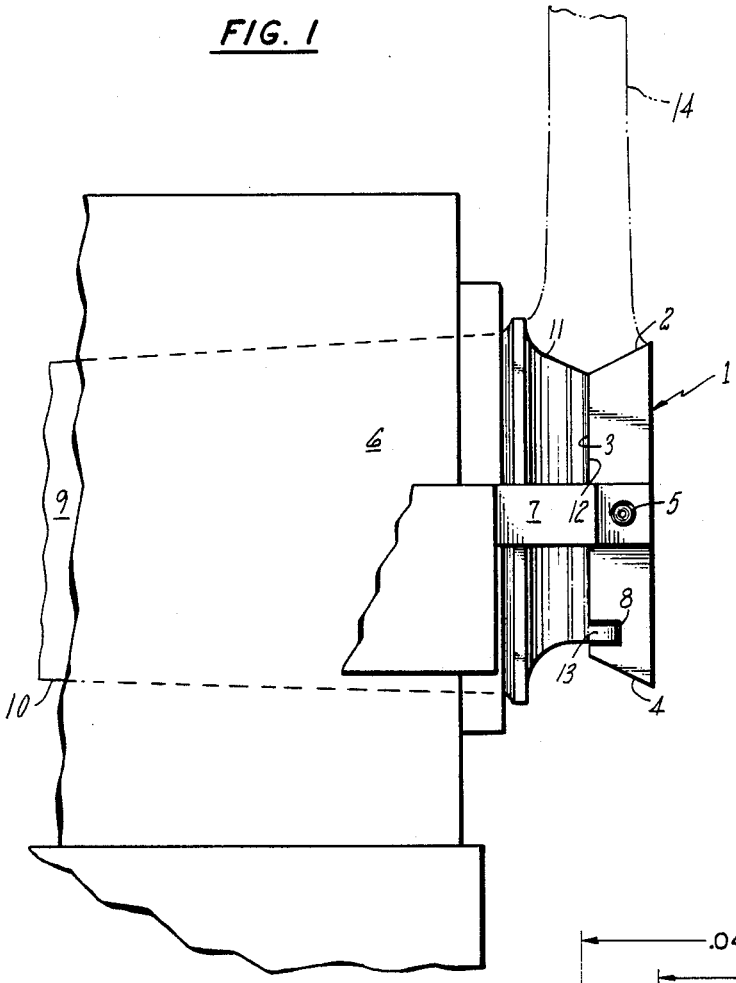
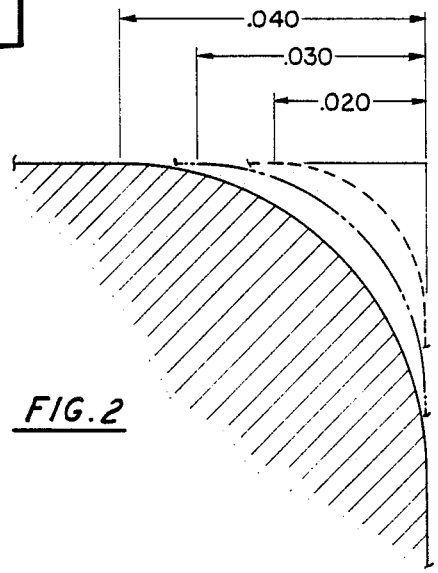
FIG. 2

APPARATUS AND METHOD FOR SELECTIVELY CONTOURING AN AIRFOIL ROOT

CROSS REFERENCE TO RELATED APPLICATION

This application is a continuation of application Ser. No. 056,336, filed May 22, 1987, which is a continuation-in-part of application Ser. No. 016,015, filed Feb. 19, 1987 both now abandoned.

TECHNICAL FIELD

This invention relates to gas turbine engine airfoils and more particularly to methods of radiusing an airfoil root utilizing a buffing wheel.

BACKGROUND ART

Buffing wheels are known for surfacing finishing various articles. For example, in U.S. Pat. No. 4,241,471 to Elias, a buffing wheel is used to polish the surface of a windshield. Similarly, in U.S. Pat. No. 4,606,152 to Michihara et al., a buffing wheel is used to polish the weft guide path of profiled reed blades.

Generally, buffing involves the smoothing and brightening of a surface by an abrasive compound pressed against a workpiece by means of a soft wheel or belt. The abrasive is usually a fine powder mixed with a wax to form a smooth paste. The paste is applied to the wheel as required. The wheel is made of a pliable material such as soft leather, linen, muslin or felt. Soft wheels prevent overpolishing by adapting to the workpiece surface. While buffing has been used to polish surfaces, it has not been used to provide surface contouring due to the pliable nature of the wheel.

Airfoils are generally produced by forging or investment casting which provide a near net shape article. For example, compressor blade may be forged from titanium or nickel alloys. However, some adjustments may be required to achieve the final surface contour. In particular, the root structure which is contoured to slottingly engage a disk may require the selective contouring of edges to ensure proper engagement of the root with the disk, with another benefit being increased fatigue life. Sharp edges provide stress concentration zones which become the focal point for crack initiation and fatigue failure. Utilizing grinding or milling operations to remove such edges has proven satisfactory due to overly agressive metal removal, frictional heating and the requirement for an additional surface finishing operation.

DISCLOSURE OF INVENTION

According to the present invention, a buffing guide is disclosed for selectively contouring an edge of an article. The guide comprises a body having a mating surface shaped to engage a surface of the article and includes at least one sloped guide surface for directing buffing means, such as a rotatable buffing wheel into precise contact with the edge at a point where selective contouring is desired.

In operation, an article edge is radiused by securing the article to prevent movement and engaging the article with the buffing guide mating surface. A buffing wheel or other buffing device is then directed into contact with the guide surface and the root surface, with the guide surface directing the buffing wheel into precise contact with the root surface at the edge where contouring is desired. By precisely maintaining contact of the buffing wheel with the root edge surface, gradual abraiding occurs at the point of initial contact, expanding to adjacent surface areas, thereby further increasing contact of the wheel until a contoured surface is provided. Utilizing the buffing guide and a soft buffing wheel provides a finished radiused edge surface while avoiding the detrimental effects of grinding or milling operations. This method is particularly useful in selectively contouring the edges of an airfoil root, eliminating sharp edged stress concentration zones and thereby increasing fatigue life.

BRIEF DESCRIPTION OF DRAWINGS

FIG. 1 is an illustration of the buffing guide of the present invention engaging an airfoil root edge surface which is selectively contoured by a buffing wheel.

FIG. 2 is an exploded view of a root edge undergoing selective contouring.

FIG. 4 is a top view showing the swing arm assembly disengaged from the root, with the engaged view shown in phantom.

FIG. 5 is a front cutaway view of the swing arm assembly.

BEST MODE FOR CARRYING OUT THE INVENTION

Figure 3:
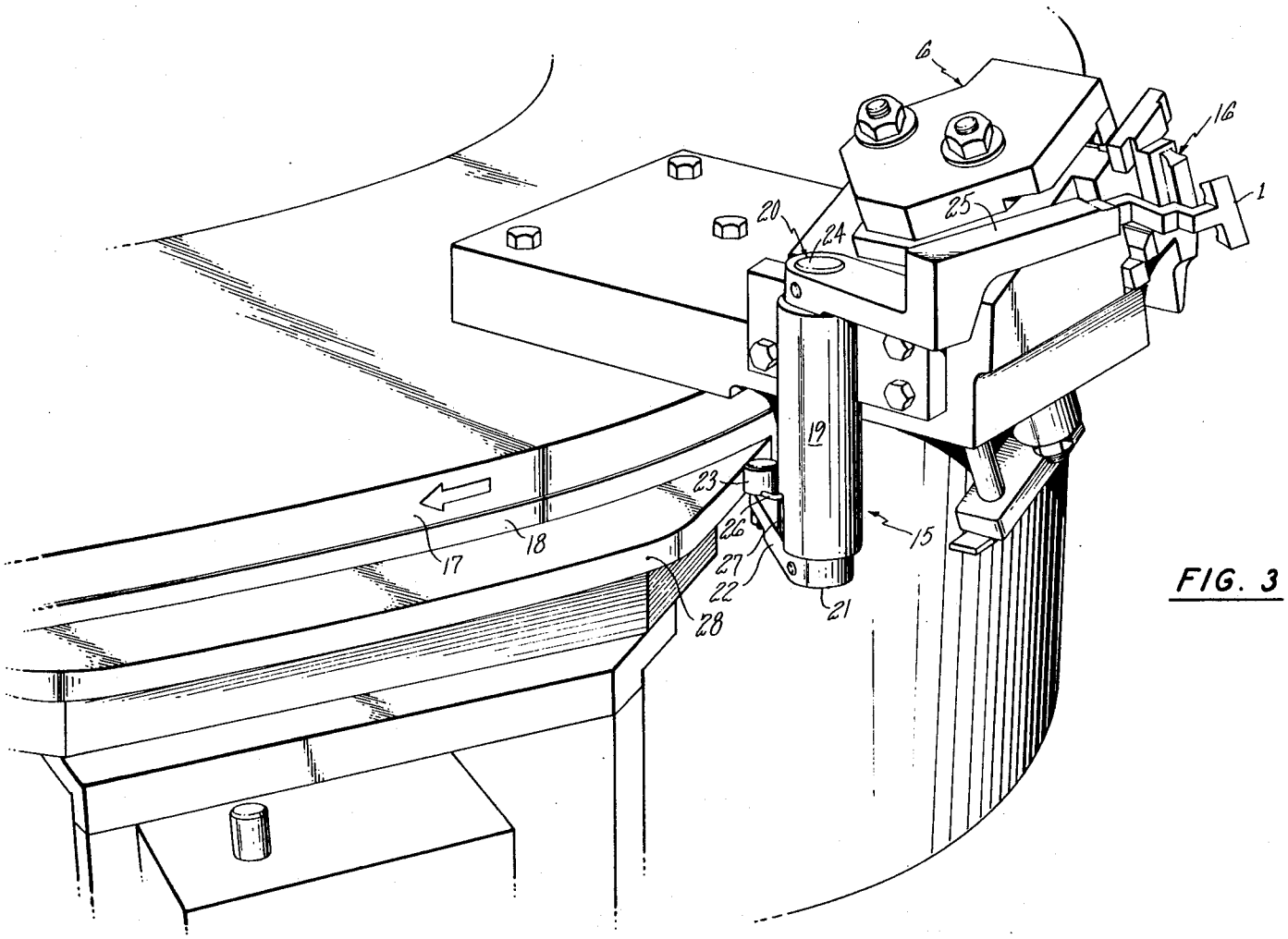
FIG. 3 is a view showing a swing arm assembly for directing the buffing wheel guide into and out of engagement with an airfoil root.

Referring to FIG. 1, a buffing guide 1 includes a first guide surface 2, a mating surface 3, a second guide surface 4 and an attachment pin 5. Two guide surfaces are provided to allow upper and lower radiusing to be performed simultaneously, with the number of guide surfaces determined by the article to be contoured. The guide 1 is connected to a clamping device 6 by an arm 7 which attaches to the guide 1 at the pin 5. The guide 1 is rotatable about the pin 5 for ease in positioning. The guide 1 also includes a slot 8.

Referring again to FIG. 1, an airfoil 9 having a blade 10 and a root 11 is placed in the clamping device 6. The mating surface 3 of the guide 1 contacts a rearward end 12 of the root 11 which also includes a tab 13 which mates with the slot 8. This protects the tab from contact with the buffing wheel as well as assures accurate alignment.

With the guide in the engaged position and the tab sheltered in the slot, a buffing wheel 14 is moved into contact with the root edge surface of the airfoil and the guide surface of the guide. For illustrative purposes, a puckered cloth buffing wheel made by the Reliable Puckered Cloth Buff Company and having a diameter of 18 inches, width of 0.5 inches and comprising $2\times10$ plies of biased cloth construction may be used. The angular slope of the guide surface 2 directs the wheel into precise contact with the root edge at the point where selective contouring is desired and ensures maximum abrasion in the area to be radiused. For example, the guide surfaces 2 and 4 have an angled slope of about 45°.

the angle of the guide surface determines the point of contact and, therefore, varying the angle varies the contour of the surface. Attempts at selective contouring root edges without a buffing guide resulted in improper contouring as the pliable buffing wheel skipped over the critical area. Without the counterdirecting effect of the buffing guide surface, selective contouring could not be achieved. Consequently, an angled slope between 10° and 90° may be used to direct the buffing means, with 40° to 80° preferred.

With the wheel in contact with the root edge, a solid bar abrasive compound is brought into periodic contact with the wheel. One such buffing compound, manufactured by Lea Manufacturing, Waterbury, Conn., contains fused aluminum oxide and calcined alumina abrasive, having a particle size from 2–40 microns, averaging 10 microns. While such a compound is exemplary, it will be understood that the choice of compound is within the users discretion.

The wheel is maintained in contact with the edge until the desired contour is achieved. Referring to FIG. 2, the progressive abrading of an edge is illustrated. Generally, up to 0.050 inches may need to be removed to provide the selected contour to an airfoil root edge. An important advantage of the present method is that at all intermediate stages of metal removal, the surface is smooth and fault free. Consequently, precise metal removal is achieved. Should grinding or milling be utilized, further surface finishing would be required up to the depth of the tool marks which may vary from article to article. Utilizing a soft buffing wheel in place of a grinding or milling machine, therefore, eliminates overheating or excessive surface roughening while providing a smoothly contoured surface. By utilizing the buffing guide, reproducibility between articles is enhanced and automation of the finishing operation is facilitated.

The buffing wheel guide is particularly useful in robotic buffing operations. Referring to FIG. 3, a swing arm assembly 15 is shown which provides automatic engagement/disengagement of the buffing wheel guide with an airfoil root 16 for processing on a circular rotating worktable 17 having a plurality of workstations (not shown) disposed therearound. The spring arm assembly 15 is mechanically actuated, eliminating the need for external electrical or pneumatic actuators.

Referring still to FIG. 3, the clamping device 6 is fixedly mounted to the rotating worktable 17, which sits above a fixed table 18. The swing arm assembly 15 is side mounted to the device 6, having a hollow cylindrical holder 19 with a shaft 20 extending therethrough. On a first end 21 of the shaft 20, is attached a cam arm 22 having a cam roller 23 rotatably attached at an outward end thereof. On a second end 24 of the shaft 20, is attached a swing arm 25 which extends about the clamping device 6, with the buffing wheel guide 1 mounted at the outward end thereof. A spring 26, shown in more detail in FIG. 5, is also disposed within the holder for biasing the swing arm towards the airfoil root, with a slot 27 in the holder restraining the spring.

In operation, a cam surface 28 is attached to the fixed table 18 at a desired location. At the rotating table 17 rotates, the clamping device 6 approaches the cam surface 28. The cam roller 23 engages the cam surface, rotating the shaft and driving the swing arm 25 away from the airfoil disposed within the clamping device. The table may then be stopped and the clamping device opened for removal of the finished airfoil. An unfinished airfoil may then be inserted, the clamping device closed and the table again rotated. The cam roller 23 then disengages from the cam surface 28, with the spring 26 biasing the buffing wheel guide 1 into engagement with the airfoil root. FIG. 4 shows the swing arm assembly in the disengaged position, with the engaged position shown in phantom.

While a particular cam roller and spring actuated swing arm assembly is shown, it will be understood by those skilled in the art that various modifications can be made to the cam arm, swing arm, and cam surface without varying from the present invention.

While the invention has been shown and described in relation to a particular guide slope and buffing wheel configuration, it will be understood by those skilled in the art that other modifications could be made without varying from the scope of the present invention.

Having thus described the invention, what is claimed is:

1. A method for radiusing an edge of an article using a pliable buffing means, said method comprising:

securing said article to prevent movement thereof;

providing a buffing guide which includes a mating surface shaped to engage a surface of said article, and at least one guide surface which slopes toward said edge at an angle sufficient to counteract any inclination of the pliable buffing means to skip off the edge, providing precise contact of the pliable buffing means with said edge where radiusing is desired;

placing said buffing guide on an engagement means for moving the buffing guide into and out of engagement with the surface of the article;

directing said engagement means to move the buffing guide into contact with the surface of said article;

directing said pliable buffing means into simultaneous contact with said guide surface and said edge of said article such that precise contact is achieved between said buffing means and said edge of said article; and, maintaining said simultaneous contact until the desired radiusing is achieved.

2. The method of claim 1 wherein said buffing guide includes a first guide surface and a second guide surface for simultaneously contouring said article in two locations.

3. The method of claim 1 wherein said guide surface has a slope of from 10°–90°.

4. The method of claim 3 wherein said guide surface has a slope of from 40°–80°.

5. The method of claim 1 wherein said pliable means comprise a rotatable cloth buffing wheel.

6. A method for radiusing an edge of an airfoil root using a pliable buffing means, said method comprising:

securing said article to prevent movement thereof;

providing a buffing guide which includes a mating surface shaped to engage a surface of said root, and at least one guide surface, which slopes toward said edge at an angle sufficient to counteract any inclination of the pliable buffing means to skip off the edge, providing precise contact of the pliable buffing means with the root edge where radiusing is desired;

placing said buffing guide on an engagement means for moving the buffing guide into and out of engagement with the surface of said root;

directing said engagement means to move the buffing guide into contact with the surface of said root;

directing said pliable buffing means into simultaneous contact with said guide surface and said edge, such that precise contact is achieved between said buffing means and said edge of said root; and, maintaining said simultaneous contact until the desired radiusing is achieved.

7. The method of claim 6 wherein said buffing guide includes a first guide surface and a second guide surface for simultaneously contouring said root in two locations.

8. The method of claim 6 wherein said guide surface has a slope of from 10°-90°.

9. The method of claim 8 wherein said guide surface has a slope of from 40°-80°.

10. The method of claim 4 wherein said buffing means comprise a rotatable cloth buffing wheel.

11. The buffing guide of claim 12 wherein said swing arm assembly includes a spring disposed within said holder for biasing said buffing wheel guide into engagement with said article.

12. A buffing guide for selectively contouring an edge of an article, said guide comprising:

a body which includes a mating surface shaped to engage a surface of said article and at least one guide surface, said guide surface sloped to provide precise contact of buffing means with said article at said edge where selective contouring is desired; and, engagement means for moving said buffing wheel guide into contact with said article, said engagement means comprising a swing arm assembly including a holder having a rotatable shaft disposed therein, said swing arm attached to an end of the shaft, said swing arm having the buffing wheel guide attached thereto, a cam arm attached to an opposite end of said shaft, said cam arm being engageable by a cam surface for moving said buffing wheel guide into and out of contact with said article.

* * * * *

UNITED STATES PATENT AND TRADEMARK OFFICE

CERTIFICATE OF CORRECTION

PATENT NO. : 4,914,872

DATED : April 10, 1990

INVENTOR(S) : Kurt R. Snyder, Randy M. DiNallo, Steve J. Mezei and Eddie L. Teaster It is certified that error appears in the above-identified patent and that said Letters Patent is hereby corrected as shown below:

Column 2, line 53, delete "Puckered Cloth".

Column 2, line 62, "the" should be --The--.

Column 3, line 55, "At" should be --As--.

Column 4, line 45, after "pliable" insert --buffing--.

Column 4, line 46, "comprise" should be --comprises--.

Column 4, line 49, "article" should be --airfoil--.

Signed and Sealed this

Eleventh Day of June, 1991

*Attest:*

*Attesting Officer*

HARRY F. MANBECK, JR.

*Commissioner of Patents and Trademarks*